US005088123A

United States Patent [19]

MacDonald

[11] Patent Number: 5,088,123

[45] Date of Patent: Feb. 18, 1992

[54] PROTECTIVE GARMENT

[75] Inventor: Ross E. MacDonald, North Attleboro, Mass.

[73] Assignee: Whiting and Davis Company, Inc., Plainville, Mass.

[21] Appl. No.: 698,265

[22] Filed: May 10, 1991

[51] Int. Cl.[5] ..... A41D 19/00

[52] U.S. Cl. ..... 2/162; 2/161 R; 2/264

[58] Field of Search ..... 2/159, 161 R, 162, 264, 2/2, 2.5, 257, 258, 60, 169, 167, 170

[56] References Cited

U.S. PATENT DOCUMENTS

| | | | |
|---|---|---|---|
| 629,901 | 8/1899 | Greenstreet | 2/161 R X |
| 676,210 | 6/1901 | Torley | 2/264 |
| 750,903 | 2/1904 | Shrum et al. | 2/264 X |
| 1,270,697 | 6/1918 | Chapman | 2/159 |
| 1,445,094 | 2/1923 | Lindfelt | 2/159 |
| 2,067,424 | 2/1935 | Steinberger | 2/159 |
| 2,540,234 | 2/1951 | Berger et al. | 2/158 |
| 2,862,208 | 12/1958 | Castro | 2/161 |
| 3,883,898 | 5/1975 | Byrnes, Sr. | 2/167 |
| 4,004,295 | 1/1977 | Byrnes, Sr. | 2/161 |
| 4,388,733 | 6/1983 | Anstett | 2/161 |
| 4,493,865 | 1/1985 | Kuhlmann et al. | 428/52 |
| 4,507,353 | 3/1985 | Kuhlmann et al. | 428/222 |
| 4,750,218 | 6/1988 | Ziegler | 2/162 X |

*Primary Examiner*—Werner H. Schroeder
*Assistant Examiner*—Sara M. Current
*Attorney, Agent, or Firm*—Salter & Michaelson

[57] ABSTRACT

A protective garment includes a wire mesh portion made from a wire material comprising a plurality of loosely interlinked metal wire rings, and at least one helically coiled stiffening element which is interwoven through a plurality of the metal wire rings in the wire mesh portion for maintaining the latter in a predetermined orientation. The garment can be effectively embodied as a protective glove which includes a wire mesh cuff portion having a plurality of helically coiled stiffening elements interwoven therein to maintain the cuff portion in a predetermined form.

14 Claims, 1 Drawing Sheet

PROTECTIVE GARMENT

BACKGROUND AND SUMMARY OF THE INVENTION

The instant invention relates to protective garments, and more particularly to a protective garment made at least partially from a wire mesh material comprising a plurality of loosely interlinked metal wire rings.

It has generally been found that protective garments made from metal wire mesh materials can be effectively utilized for protecting workers in industries, such as the meat cutting industry, against inadvertent knife cuts and puncture wounds. In this regard, a number of different types of metal wire mesh garments, including aprons, coats, gloves, and sleeves have been heretofore available and have been found to be effective for protecting workers against knife wounds. Many of these heretofore available garments have been constructed from wire mesh materials made from relatively large numbers of small interlinked wire rings. However, because materials of this type are inherently limp, i.e. they have no inherent stiffness or form, garments made from these materials tend to collapse or sag unless they incorporate stiffening or retaining elements which maintain them in predetermined forms. For example, it has been found that while it is important for wire mesh gloves to include cuff or gauntlet portions to protect the wrists of workers, the cuff or gauntlet portions of such gloves generally tend to collapse or sag toward the hand portions thereof unless they are supported with stiffening members or supporting straps. As a result, it has been found that the highly vulnerable wrist areas of workers wearing conventional gloves are frequently left unprotected against knife wounds. As an alternative, workers have frequently found it necessary to wear relatively uncomfortable separate plastic cuffs or the like, to protect their wrists against knife wounds.

While various types of stiffening elements have been heretofore available for use in connection with garments made from various fabric materials, the previously available stiffening elements have generally not been practical for use in connection with wire mesh garments, particularly those which are designed for use in the meat cutting industry. In this connection, in order to be effective for use in connection with a wire mesh garment a stiffening element must be capable of being readily and easily secured to the wire mesh portion of the garment, and it must be capable of being effectively and easily cleaned in order to maintain the garment in a sanitary condition. Further, a stiffening element must be capable of maintaining a garment in a predetermined orientation while also allowing the garment to remain sufficiently flexible so that it can be comfortably worn by a user. As a general rule, the heretofore available stiffening elements for garments have simply failed to meet all of these criteria.

The closest prior art to the subject invention of which the applicant is aware is disclosed in the U.S. Pat. to Chapman No. 1,270,697; Lindfeldt No. 1,445,094; Steinberger No. 2,067,424; Berger et al No. 2,540,234; Castro No. 2,862,208; Byrnes, Sr. No. 3,883,898; Byrnes, Sr. 4,004,295; Anstett No. 4,388,733; Kuhlmann et al No. 4,493,865; and Kuhlmann et al No. 4,507,353. However, while these references disclose a variety of different types of protective garments, several of which include stiffening elements, they fail to suggest a garment which includes helically coiled stiffening elements which are interwoven through a wire mesh material in the manner of the stiffening elements of the garment of the instant invention, and hence, they are believed to be of only general interest with respect thereto.

The instant invention provides an effective protective garment which includes a wire mesh portion comprising a plurality of loosely interlinked wire rings, and a plurality of resiliently flexible stiffening elements which are operative for maintaining at least a portion of the wire mesh portion in a predetermined orientation. In this regard, the stiffening elements are specifically adapted so that they are effectively operable in combination with a predetermined wire mesh portion of a garment for effectively maintaining the wire mesh portion in a predetermined orientation while nevertheless maintaining a sufficient degree of flexibility in the garment to enable it to be comfortably worn by a user. Further, the stiffening elements of the garment of the instant invention are adapted so that they are hygienically safe and so that they can be effectively cleaned by conventional cleaning processes.

More specifically, the garment of the instant invention comprises a wire mesh portion of the abovedescribed type and at least one resiliently coiled stiffening element which is preferably made from a resilient corrosion resistant metal, such as stainless steel. The garment preferably comprises a plurality of stiffening elements which are preferably disposed in spaced, substantially parallel relation, and the stiffening elements are interwoven through the wire rings in the wire mesh portion of the garment for maintaining the wire mesh portion in a predetermined orientation. The wire rings in the wire mesh portion are preferably disposed in a plurality of rows of loosely interlinked wire rings wherein adjacent wire rings in adjacent rows are interlinked, and the helically coiled stiffening elements are preferably interwoven through each of a plurality of sequential adjacent wire rings in each of two adjacent rows of wire rings. The wire rings in the wire mesh portion of the garment are preferably of substantially circular configuration and of substantially uniform diameter, and the distance between adjacent coils in the helically coiled stiffening element is preferably substantially equal to the diameter of the wire rings.

It has been found that the protective garment of the instant invention can be effectively embodied as a protective glove comprising connected hand and cuff portions and adapted to be received on a hand of a wearer so that the cuff portion extends a distance upwardly along the adjacent wrist of the wearer. The stiffening elements are preferably received in the cuff portion of the glove for maintaining the cuff portion in a predetermined position wherein it is retained against collapsing toward the hand portion when the glove is worn on a hand of a wearer. Specifically, the glove preferably includes a plurality of stiffening elements which are received in the cuff portion in uniformly spaced substantially parallel relation so that they extend upwardly toward the elbow of a wearer for preventing the cuff portion from collapsing downwardly toward the hand portion. The glove preferably further comprises first and second strap portions which are attached to opposite first and second ends of the cuff portion and adapted so that they are receivable in circling relation around a wrist of a wearer when the glove is received on an adjacent hand. The opposite ends of the stiffening elements are preferably embedded in the strap portions so that the stiffening elements extend between the strap portions for maintaining the strap portions in substantially uniformly spaced relation.

It has been found that the protective garment of the instant invention can be effectively utilized for protecting a wearer against inadvertent knife wounds during meat cutting operations. Specifically, it has been found that the stiffening elements are effectively operative for maintaining the garment of the instant invention in a predetermined orientation wherein it is most effective for protecting the body of a wearer. It has been further found that the stiffening elements are hygienically safe and that they can be readily and easily cleaned along with the remainder of the garment. It has been further found that the stiffening elements are highly resistant to deterioration and breakage so that they can be effectively utilized for maintaining the glove of the instant invention in a predetermined form over a prolonged period of time.

Accordingly, it is a primary object of the instant invention to provide an improved protective garment for use in meat cutting operations.

Another object of the instant invention is to provide an effective protective garment comprising a wire mesh portion and a helically coiled stiffening element which is interwoven in the wire mesh portion for maintaining the latter in a predetermined orientation.

An even further object of the instant invention is to provide a protective garment comprising a wire mesh portion and a plurality of helically coiled wire stiffening elements which are operative for maintaining the wire mesh portion in a predetermined orientation.

An even still further object of the instant invention is to provide an effective wire mesh glove including a cuff portion having a plurality of helically coiled wire stiffening elements therein for maintaining the cuff portion in a predetermined orientation.

Other objects, features and advantages of the invention shall become apparent as the description thereof proceeds when considered in connection with the accompanying illustrative drawings.

DESCRIPTION OF THE DRAWING

In the drawing which illustrates the best mode presently contemplated for carrying out the present invention.

DESCRIPTION OF THE INVENTION

Figure 1:
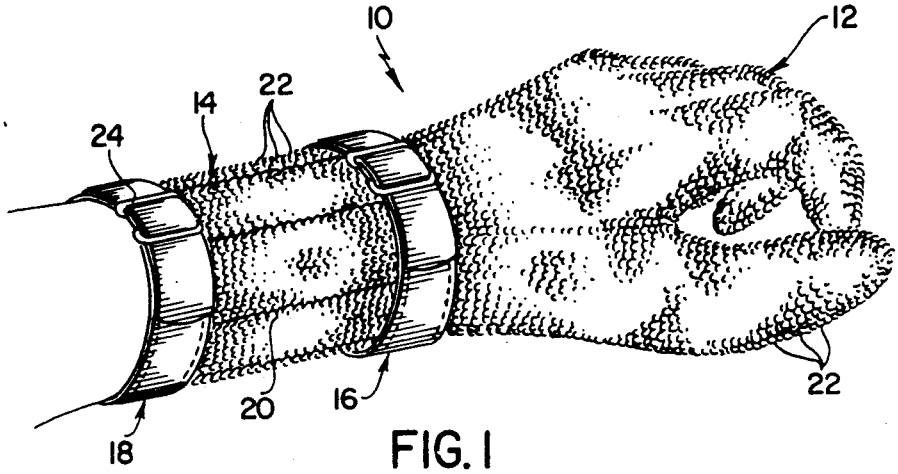
FIG. 1 is a perspective view of the glove of the instant invention on a hand of a wearer.
Figure 2:
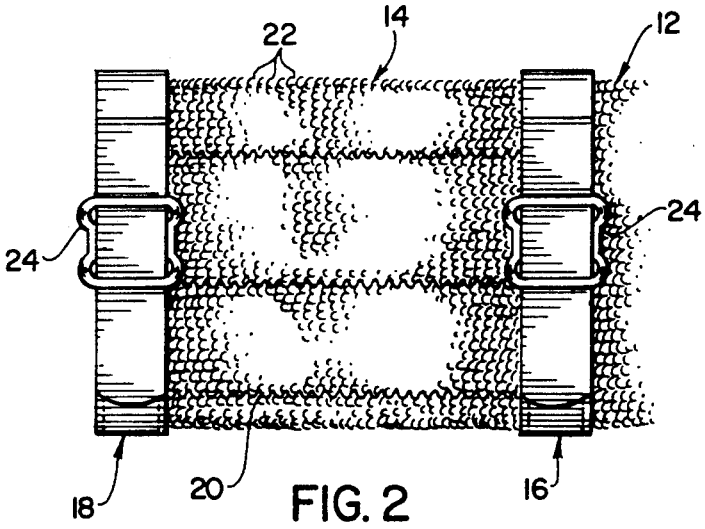
FIG. 2 is a top plan view of the cuff portion thereof.
Figure 3:
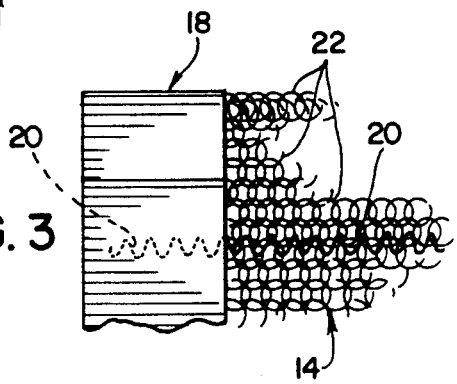
FIG. 3 is an enlarged fragmentary view of the cuff portion.

Referring now to the drawings, the protective garment of the instant invention is illustrated in FIGS. 1 through 3 and generally indicated at 10 in FIG. 1. The garment 10 as herein embodied comprises a protective glove, although it will be understood that the garment of the 7 instant invention can be alternatively embodied in a variety of other configurations, including a protective sleeve, a protective apron, or a protective coat. The protective glove 10 comprises a hand portion generally indicated at 12 and a cuff portion generally indicated at 14. The glove 10 further comprises first and second strap portions 16 and 18, respectively, which are positioned adjacent opposite ends of the cuff portion 14, and a plurality of helically coiled stiffening elements 20 which are received in the cuff portion 14 for maintaining the latter in a predetermined orientation.

The hand portion 12 is preferably constructed from a wire mesh material comprising a plurality of loosely interlinked circular metal wire rings 22. The metal wire rings 22 are preferably disposed in loosely interlinked rows of wire rings wherein adjacent wire rings in the same row are interlinked, and adjacent wire rings in adjacent rows are also interlinked. The hand portion 12 is formed in the configuration of a conventional glove so that it is receivable on a hand of a wearer for protecting the hand during a meat cutting operation. As illustrated, the hand portion 12, as herein embodied, is adapted to be received on the left hand of a wearer, although obviously it could alternatively be adapted to be received on the right hand. In any event, because the hand portion 12 is constructed from a plurality of loosely interlinked rings 22, the wire mesh material from which the hand portion 12 is constructed is inherently relatively limp and the hand portion 12 can readily conform to the configuration of a wearer's hand.

The cuff portion 14 is also constructed from a wire mesh material comprising a plurality of loosely interlinked substantially circular metal rings 22. Further, the metal rings 22 in the cuff portion 14 are preferably also disposed in rows of loosely interlinked rings wherein the links in each row are interlinked with adjacent rings in the same row as well as adjacent rings in adjacent rows. The cuff portion 14 is preferably formed in a tubular configuration and it is dimensioned to be received over the wrist portion of an arm of a wearer for protecting the wrist portion against inadvertent wounds during a meat cutting operation. A pair of adjustment slits (not shown) are preferably provided in the cuff portion 14 to enable the glove to be more easily assembled on the hand and wrist of a wearer, and to permit the cuff portion 14 to be easily adjusted to the exact dimension of the wrist. The adjustment slits (not shown) preferably extend longitudinally inwardly short distances from opposite ends of the cuff portion 14.

The first and second strap portions 16 and 18, respectively, preferably comprise conventional adjustment straps made from a relatively heavy, durable webbing material, such as nylon. The strap portions 16 and 18 preferably each include at least two layers of webbing material, and they are secured to opposite ends of the cuff portion 14 with stitching which extends through the adjacent metal wire rings. Further, the strap portions 16 and 18 are preferably secured to the cuff portion 14 so that the adjacent end portions of the cuff portion 14 are received between the two layers of each of the strap portions 16 and 18 in order to capture the opposite end portions of the cuff portion 14 between the layers of the strap portions 16 and 18. The strap portions 16 and 18 include conventional adjustable snap assemblies 24 for adjustably securing the strap portions 16 and 18 in encircling relation around the wrist of a wearer. The first strap portion 16 is also secured to the hand portion 12 so that the wire mesh material of the wrist end of the hand portion 12 is embedded between the layers of the strap portion 16, and accordingly the strap portion 16 is operative for connecting the hand portion 12 to the wrist portion 14 so that the hand and wrist portions 12 and 14, respectively, cooperate to define the hand and wrist portions of a single glove 10.

The stiffening elements 20 preferably comprise helically coiled resilient wire stiffening elements which are preferably made from a corrosion resistant metal, such as stainless steel. The helically coiled wire stiffening elements 20 are constructed so that adjacent helical coils thereof are spaced by approximately the diameter of one wire ring 22, and the stiffening elements 20 are interwoven through the wire rings 22 so that each stiffening element 20 is interwoven through each of a plurality of sequential wire rings 22 in each of two adjacent rows of wire rings 22. The glove 10 preferably comprises a plurality of stiffening elements 20 which are disposed in longitudinally extending, spaced, substantially parallel relation so that they extend between the strap portions 16 and 18 at opposite ends of the cuff portion 14. Further, the opposite end portions of the stiffening elements 20 are preferably embedded between the layers of the strap portions 16 and 18 so that a wearer of the glove 10 is protected against receiving inadvertent scratches or puncture wounds from the terminal ends of the stiffening elements 20. In any event, the stiffening elements 20 are operative for normally maintaining the strap portions 16 and 18 in uniformly spaced relation, although the stiffening elements 20 are resiliently flexible to accommodate wrist movements of a wearer. However, because the stiffening elements 20 maintain the strap portions 16 and 18 in uniformly spaced relation they prevent the cuff portion 14, which is inherently relatively limp, from moving to a collapsed position wherein the strap portion 18 is positioned adjacent the strap portion 16.

Accordingly, during use the glove 10 is assembled on the hand of a wearer in the manner illustrated in FIG. 1 so that the hand portion 12 covers the hand of the wearer and so that the cuff portion 14 covers the adjacent wrist portion of the wearer. The straps 14 and 16 are adjusted and assembled so that they encircle the wrist of the wearer to comfortably retain the cuff portion 14 in position thereon. Once the glove 10 has been assembled on the wrist of the wearer in this manner, the stiffening elements 20 operate to prevent the cuff portion 14 from collapsing downwardly toward the hand portion 12 by maintaining the strap portions 16 and 18 in substantially uniformly spaced relation. Accordingly, the cuff portion 14 can be more effectively utilized for protecting the wrist of the wearer during a meat cutting operation. Further, the cuff portion 14 is maintained in its proper orientation to minimize wearer fatigue caused by the glove 10.

It is seen therefore that the instant invention provides an effective garment for protecting a wearer against inadvertent knife wounds and the like. The stiffening elements 20 are interwoven in the metal wire rings 22 of the cuff portion 14 to maintain the cuff portion 14 in a predetermined orientation wherein it extends a distance upwardly along the wrist of a wearer toward the adjacent elbow. Accordingly, the cuff portion 14 can be more effectively utilized for protecting the wrist of the wearer against inadvertent wounds during a meat cutting operation. Hence, it is seen that the garment of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. In a protective garment including a wire mesh portion comprising a plurality of loosely interlinked wire rings, and resiliently flexible stiffening means for maintaining at least a portion of said wire mesh portion substantially in a predetermined orientation, the improvement comprising said stiffening means comprising at least one elongated resilient helically coiled stiffening element, said helically coiled stiffening element being interwoven through portion of said wire rings in said portion of said wire mesh portion for maintaining the latter substantially in said predetermined orientation.

2. In the protective garment of claim 1, said stiffening means comprising a plurality of said helically coiled stiffening elements, said helically coiled stiffening elements being disposed in spaced, substantially parallel relation and each being interwoven through a portion of said wire rings in said portion of said wire mesh portion for maintaining the latter substantially in said predetermined orientation.

3. In the protective garment of claim 1, said wire rings being disposed in a plurality of rows of loosely interlinked wire rings, adjacent wire rings in adjacent rows of wire rings being interlinked, said helically coiled stiffening element being interwoven through each of a plurality of sequential adjacent wire rings in each of two adjacent rows of said wire rings.

4. In the protective garment of claim 3, said wire rings being substantially circular and of substantially uniform diameter, the distance between adjacent coils in said helically coiled stiffening element being substantially the same as the diameter of said wire rings.

5. In the protective garment of claim 1, said helically coiled stiffening element comprising a helically coiled corrosion resistance metal wire stiffening element.

6. In the protective glove of claim 5, said at least one elongated resilient helically coiled stiffening element extending in a longitudinal direction from said hand portion toward said adjacent elbow when said glove is received on said hand of said wearer.

7. In the protective glove of claim 5, said wire rings being disposed in a plurality of rows of loosely interlinked wire rings, adjacent wire rings in adjacent rows being interlinked, said helically coiled stiffening element being interwoven through each of a plurality of sequential wire rings in each of two adjacent rows of said wire rings.

8. A protective glove comprising a hand portion and a cuff portion attached to said hand portion, said glove being adapted to be received on a hand of a wearer so that said cuff portion extends a distance upwardly along an adjacent wrist toward an adjacent elbow of said wearer, said cuff portion including a wire mesh portion comprising a plurality of loosely interlinked wire rings and resiliently flexible stiffening means for maintaining at least a portion of said wire mesh portion in a predetermined orientation, said stiffening means comprising at least one elongated resilient helically coiled stiffening element interwoven through a portion of said wire rings in said portion of said wire mesh portion for maintaining the latter substantially in said predetermined orientation.

9. In the protective glove of claim 8, said stiffening means further comprising a plurality of said helically coiled stiffening elements, said helically coiled stiffening elements being disposed in spaced, substantially parallel relation and each being interwoven through a portion of said wire rings in said portion of said wire mesh portion for maintaining the latter substantially in said predetermined orientation.

10. In the protective glove of claim 9, said helically coiled stiffening elements being disposed in spaced substantially parallel relation and each being interwoven through a portion of said wire rings in said wire mesh portion for maintaining the latter substantially in said predetermined orientation.

11. In the protective glove of claim 8, said cuff portion having longitudinally opposite first and second ends which are spaced in a direction extending from said hand of said wearer toward said adjacent elbow when said glove is received on said hand of said wearer, said glove further comprising first and second strap portions attached to opposite first and second ends, respectively, of said cuff portion, said strap portions being adapted to be received in substantially encircling relation around said wrist of said wearer when said glove is received on the hand of said wearer.

12. In the protective glove of claim 11, said at least one elongated, resilient, helically coiled stiffening element having opposite first and second ends which are embedded in said first and second strap portions, respectively.

13. In the protective glove of claim 12, said stiffening means further comprising a plurality of said helically coiled stiffening elements extending between said first and second strap portions.

14. In the protective glove of claim 6, said helically coiled stiffening element comprising a helically coiled corrosion resistant metal wire stiffening element.

* * * * *